US007568254B2

(12) United States Patent
Duncan et al.

(10) Patent No.: US 7,568,254 B2
(45) Date of Patent: Aug. 4, 2009

(54) MACHINE FOR SCRUBBING OR FINISHING FLOOR SURFACES

(75) Inventors: Christopher R. Duncan, Nr Chard (GB); John Findlay, Bridgewater (GB)

(73) Assignee: Numatic International Limited (GB)

( * ) Notice: Subject to any disclaimer, the term of this patent is extended or adjusted under 35 U.S.C. 154(b) by 624 days.

(21) Appl. No.: 11/111,469

(22) Filed: Apr. 21, 2005

(65) Prior Publication Data

US 2005/0246845 A1 Nov. 10, 2005

(30) Foreign Application Priority Data

Apr. 23, 2004 (GB) ..... 0409121.1

(51) Int. Cl.
*A47L 11/16* (2006.01)
*A47L 11/40* (2006.01)

(52) U.S. Cl. ..... 15/49.1; 15/50.1; 15/98; 15/320; 451/353

(58) Field of Classification Search ..... 15/49.1, 15/50.1, 98, 320, 339, 340.2, 385, 401; 451/350, 451/353

See application file for complete search history.

(56) References Cited

U.S. PATENT DOCUMENTS

| | | | | |
|---|---|---|---|---|
| 3,277,511 | A * | 10/1966 | Little et al. | 15/320 |
| 6,357,070 | B1 * | 3/2002 | Venard et al. | 15/50.1 |
| 6,450,867 | B1 * | 9/2002 | Legatt | 451/350 |
| 2001/0032372 | A1 * | 10/2001 | Tremmel et al. | 15/385 |

FOREIGN PATENT DOCUMENTS

| | | | |
|---|---|---|---|
| GB | 2 274 977 | A | 8/1994 |
| JP | 6153320 | | 5/1994 |
| JP | 9-66013 | * | 3/1997 |
| JP | 9-94201 | * | 4/1997 |

* cited by examiner

*Primary Examiner*—Mark Spisich
(74) *Attorney, Agent, or Firm*—Ballard Spahr Andrews & Ingersoll, LLP

(57) ABSTRACT

The disclosure relates to the floor scrubbing or finishing machines. There is provided a machine for scrubbing or finishing a floor surface comprising carriage means adapted for translational movement over a floor surface, a workhead, an electric motor carried by the carriage means and arranged in use to drive the workhead and battery support means adapted in use to support at least one battery as a source of electric power for driving the electric motor, wherein said battery support means are adapted to support said at least one battery so that said at least one battery can be positioned in a selected one of a range of positions relative to said workhead whereby the loading on said workhead can be varied as required.

7 Claims, 5 Drawing Sheets

MACHINE FOR SCRUBBING OR FINISHING FLOOR SURFACES

This invention relates to a machine for scrubbing or finishing a floor surface of the kind which comprises a carriage adapted for translational movement over a floor surface, a workhead mounted on the carriage and an electric motor carried by the carriage and arranged in use to drive the workhead. Such a machine will be referred to as "a machine of the kind described" in the remainder of this description.

The workhead may include a brush or pad carrier which is provided with means for securing a brush or pad to it so that, in use of a machine of the kind described, the brush or pad is maintained in working contact with the floor surface. The carriage may also include a pair of rear transit wheels which are mounted on an axle towards the rear of the carriage. The weight of the machine is supported on the rear transit wheels and on the workhead whilst the machine is in use.

With many machines of the kind described, it is desirable for there to be a constant pressure between the brush or pad and the floor when the machine is supported on the rear wheels and the workhead.

Battery operated machines of the kind described, which normally incorporate 24 volt battery packs, all of necessity incorporate fairly substantial battery packs which are also quite heavy. A normal 80 amp hour 12 volt battery weighs 33 kilograms and two such batteries would be required to provide 24 volts in which case the total weight of the battery pack would be 66 kilograms. These batteries would be mounted on the carriage and may be enclosed by hollow receptacles of fluid handling apparatus for supplying a cleaning solution of liquid or polish to the floor to be treated with the brush or pad and for collecting dirty liquid sucked up from the floor. One such receptacle would serve as a reservoir for the cleaning solution liquid and another as a liquid collecting receptacle for the dirty liquid.

Various means have been proposed for adjusting the pressure between the brush or pad and the floor when a machine of the kind described is in use.

An object of this invention is to provide means for adjusting the pressure between the brush or pad and the floor as required which is simple to install and operate and which is inexpensive.

Broadly, this invention comprises a system by which the pressure that is to be exerted by the brush or pad on the floor when a battery operated machine of the kind described is in use can be changed by a small movement of the battery pack either forwards or backwards relative to the workhead.

According to one aspect of this invention, there is provided a machine of the kind described which includes battery support means adapted in use to support at least one battery as a source of electric power for driving the electric motor, wherein said battery support means are adapted to support said at least one battery so that said at least one battery can be positioned in a selected one of a range of positions relative to said workhead whereby the loading of said workhead can be varied as required.

Preferably, said battery support means comprise a rolling platform. The battery support means may be a trolley which runs on rails mounted in the carriage. Conveniently, the trolley is provided with a handle by which it can be pulled or pushed a short distance along the rails within the machine. A detent arrangement may be provided for each of a plurality of selectable ones of the range of positions. The detents conveniently comprise a laterally projecting pin on the handle and a cooperating locater plate which is formed with a plurality of upwardly opening slots, each adapted to receive the pin, the slots being spaced one from another by a short distance in the direction of movement of the trolley along the rails and the handle being pivotably mounted on the trolley so that the pin can be engaged or disengaged from a respective one of the slots by lowering or raising the handle.

One form of machine for scrubbing or finishing floor surfaces in which this invention is embodied will be described now by way of example with reference to the accompanying drawings, of which:—

Figure 1:
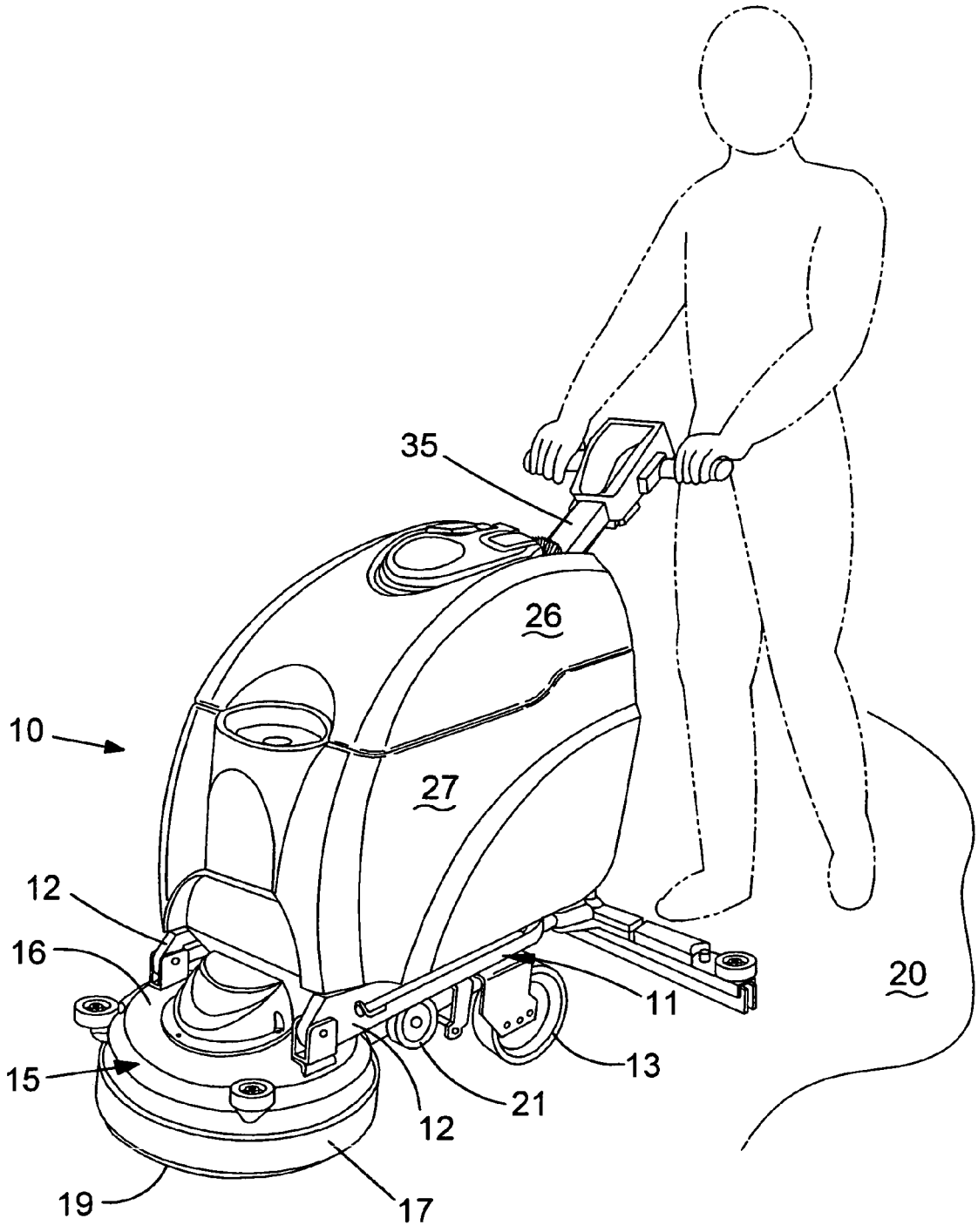
FIG. 1 is a view in perspective of the machine.

The drawings show the machine 10 for scrubbing or finishing a floor surface includes a carriage 11. The carriage 11 has two horizontally spaced apart chassis members 12 which extend between the front and the rear of the carriage 11. The carriage 11 is supported towards its rear on two spaced apart transit wheels 13 which are mounted at either end of an axle which extends transversely relative to the chassis members 12. A workhead assembly 15 is carried at the front of the carriage 11. The workhead assembly 15 includes a brush housing 16 which is formed with a depending peripheral skirt 17. An electric motor 18 (see FIGS. 3-5) is mounted on the top of the brush housing 16 with its axis extending horizontally and with its body lying between the chassis members 12. The electric motor 18 is coupled by suitable mechanical gearing (not shown) to rotate a brush 19 about a vertical axis, the brush 19 being journalled within the brush housing 16. The drawings show the brush 19 in engagement with the floor surface 20 which is the position it adopts when the machine 10 is in use to scrub or finish the floor surface 20. In this position the weight of the machine 10 is supported by the rear transit wheels 13 and the brush 19.

Figure 2:
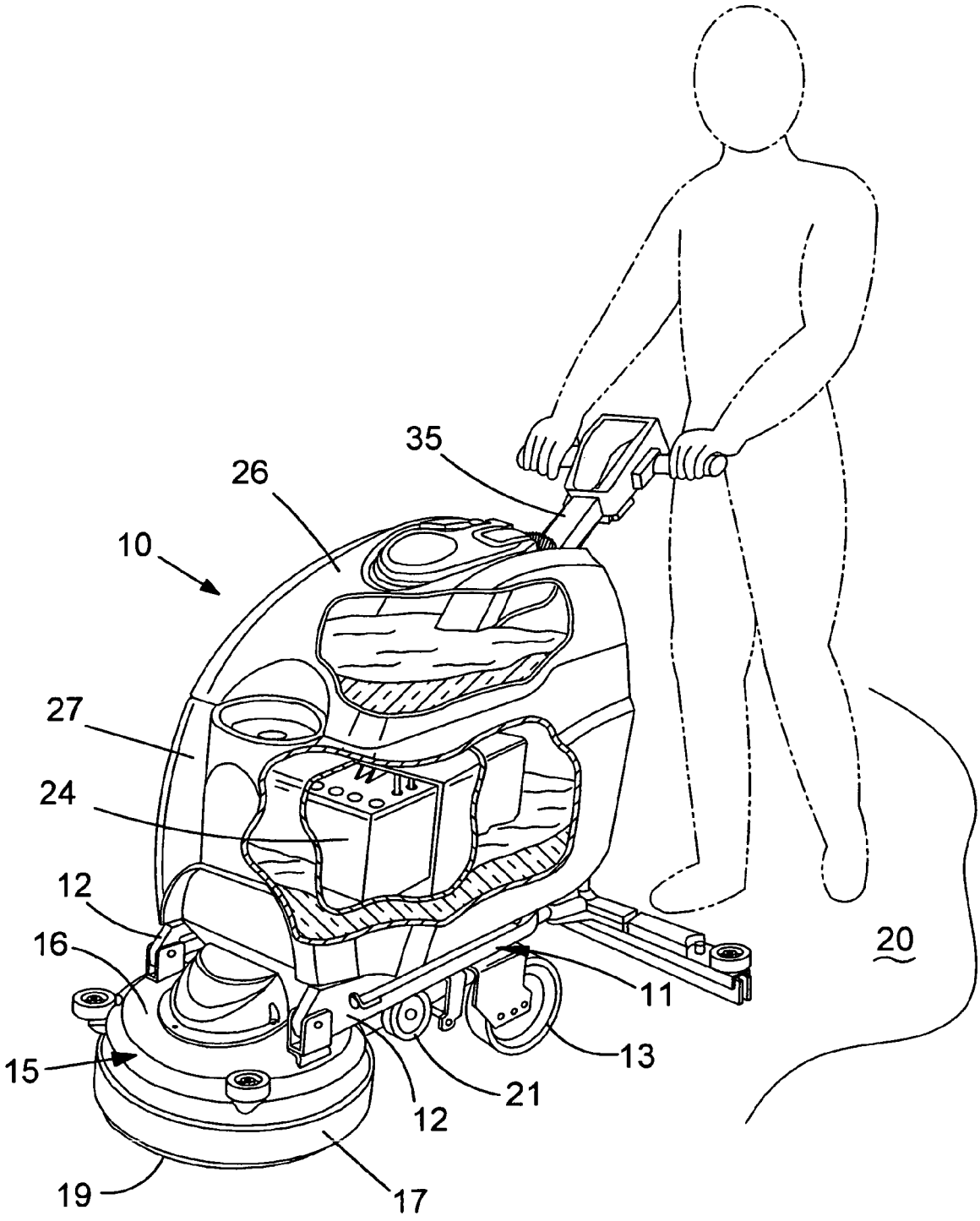
FIG. 2 is a view similar to FIG. 1 but with parts of the liquid receptacles broken away to reveal hidden detail.
Figure 3:
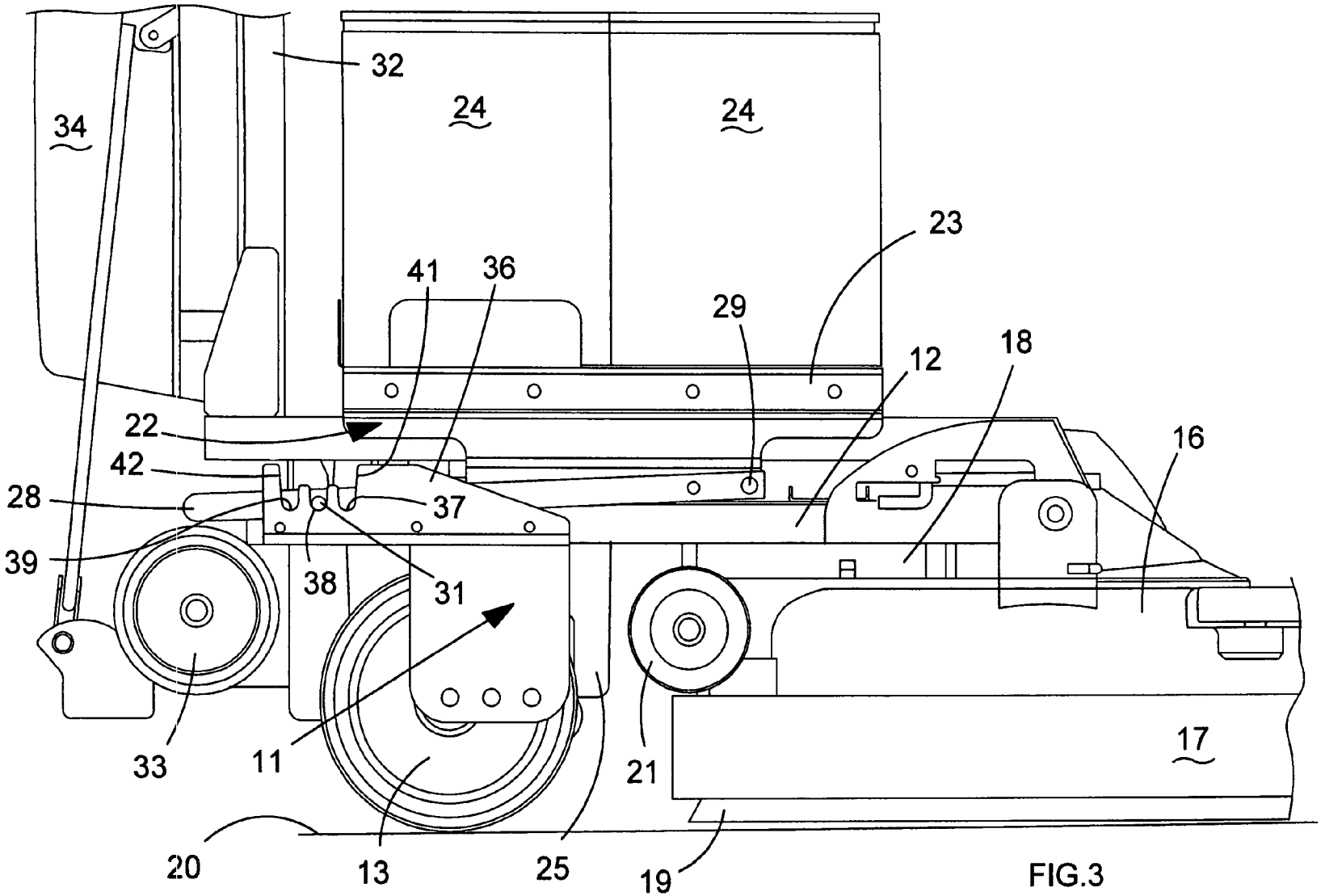
FIG. 3 is a view of part of the machine shown in FIGS. 1 and 2 with the liquid receptacles removed to expose the batteries and details of the carriage, the batteries being located at a mid-point in their range of movement in the fore and aft direction of the machine.
Figure 4:
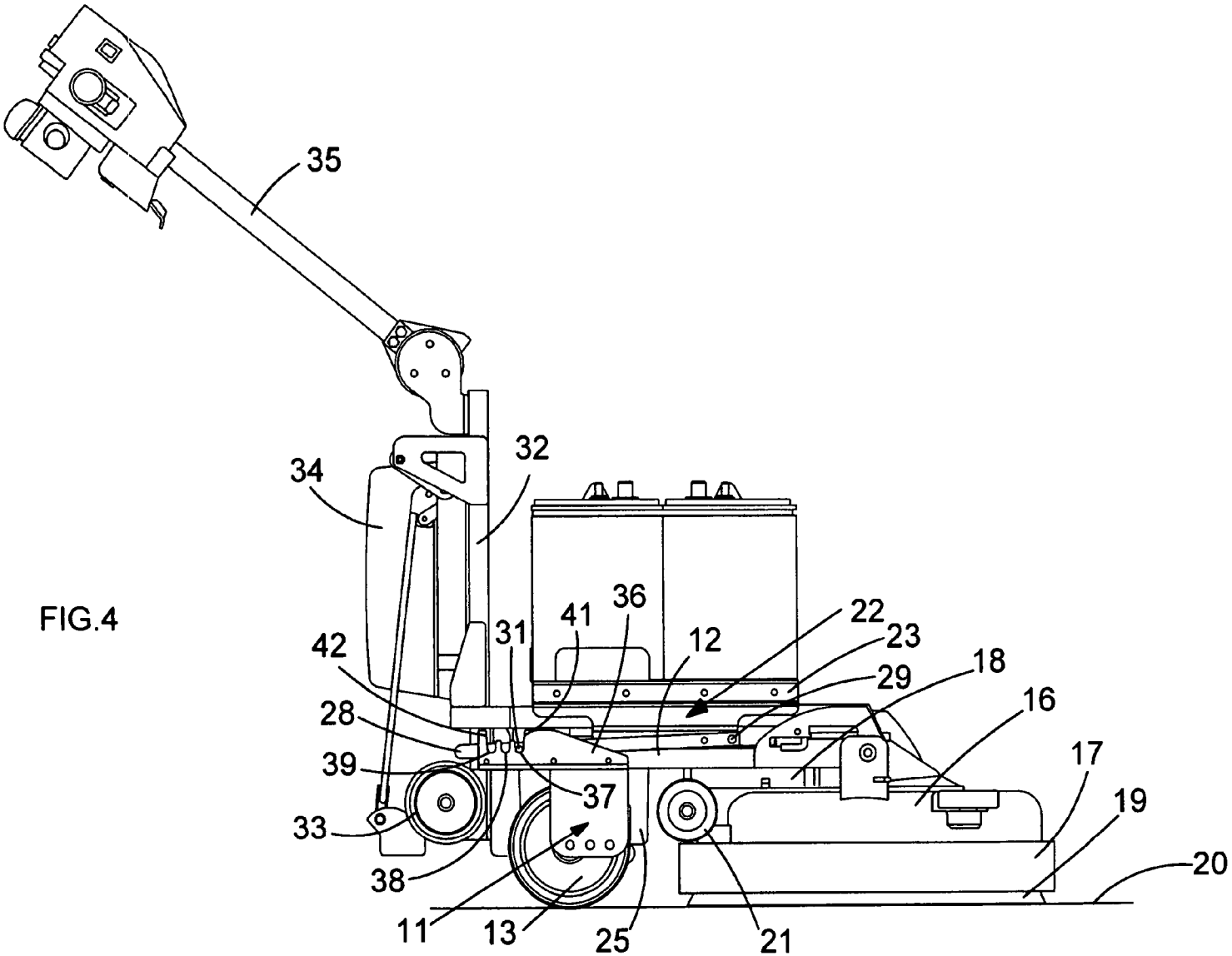
FIG. 4 is a side elevation of the machine with the liquid containing receptacles removed, the batteries being shown at the forward end of their range of movement on the carriage.
Figure 5:
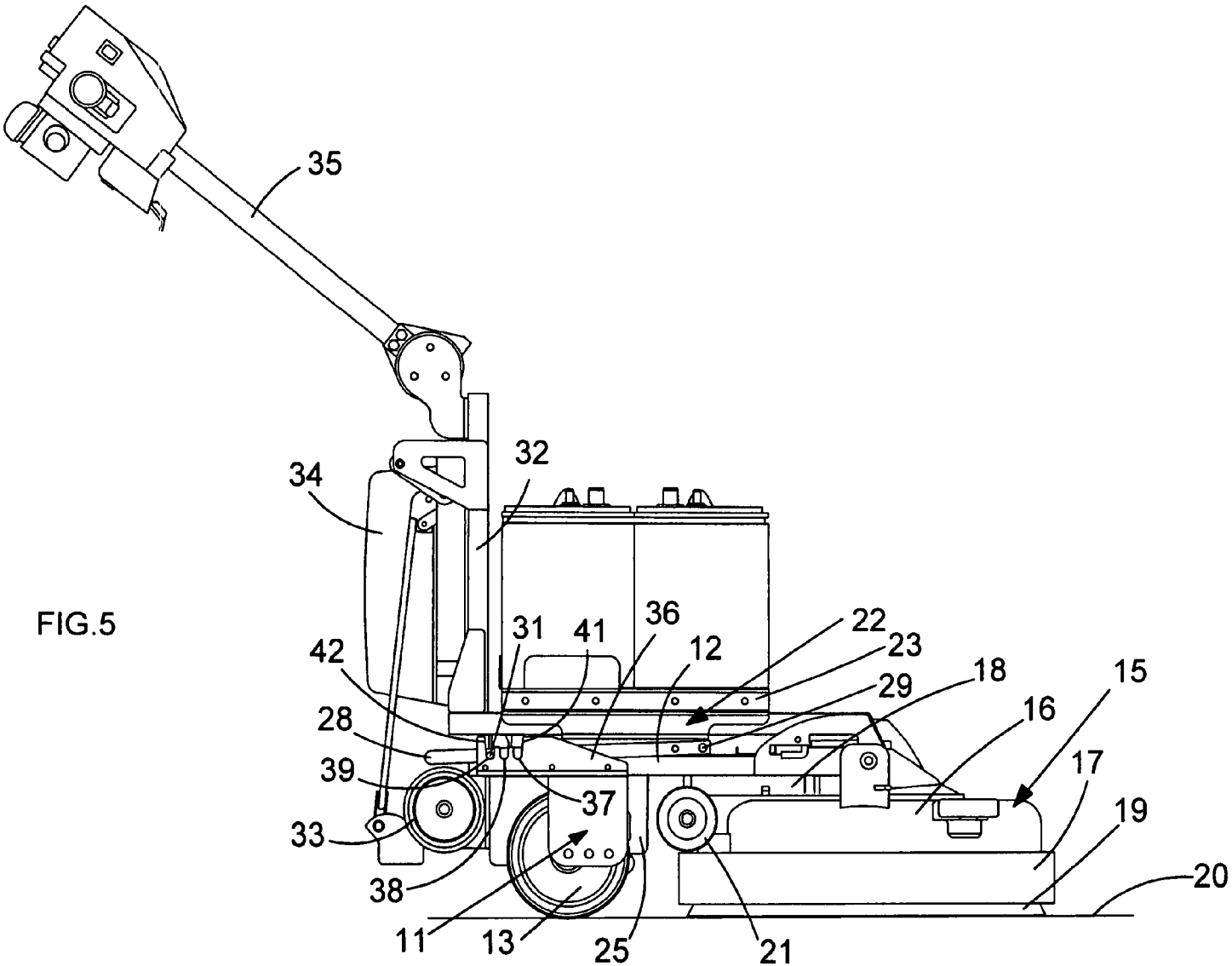
FIG. 5 is a view similar to FIG. 4 with the batteries shown at the rear of the range of movement relative to the carriage.

FIGS. 1 and 2 show the workhead assembly 15 is pivotally mounted between the chassis members 12 about a horizontal axis which is arranged substantially at right angles to the fore and aft direction of the carriage 11. The brush housing 16 carries a pair of small castors 21 at its rear. Those castors 21 are for engaging the floor surface 20 when the workhead assembly 15 is swung through an angle of the order of 100-120° in the anti-clockwise direction as seen in FIGS. 3 to 5 to which the workhead assembly 15 is moved when the machine 10 is out of use and is to be stored. This position of the workhead assembly 15 also facilitates maintenance and/or removal or replacement.

Each chassis member 12 has a rail on its upper surface. The two rails extend in a generally parallel fore and aft direction relative to the carriage 11. A trolley 22 (see FIGS. 3-5) comprises a battery support platform 23 which is mounted on two pairs of wheels (not shown), each pair of wheels running on a respective one of the pair of rails. The trolley 22 carries two 12 volt batteries 24, one behind the other on the platform 23. Each battery weighs 33 kilograms so that the total battery weight is 66 kilograms. The batteries provide a 24 volt output to power the electric motor 18 of the workhead assembly 15 and a suction pump 25 which is mounted with its axis vertical between the pair of chassis members 12 near to the rear transit wheels 13. The suction pump 25 is part of a fluid handling system of the machine 10.

The batteries 24 are surrounded by hollow liquid containers as shown in FIGS. 1 and 2. There is an upper container 26 which is adapted to receive dirty liquid pumped to it from the floor by the suction pump 25. Below the upper container 26 and extending on either side of and over the top of the batteries 24, as can be seen from FIG. 2, is a lower container 27 which supports the upper container 26 and which is mounted on the chassis members 12. The lower container 27 contains a cleaning solution liquid or polish which is for supply to the floor surface 20 to be treated with the pad or brush unit of the workhead assembly 15.

The rear of the carriage 11 comprises an upstanding panel 32 which is mounted at the rear ends of the chassis members 12. The rear panel 32 carries a pair of wheels 33 which are arranged to engage the ground when the machine 10 is adjusted into its position for storage by raising the front of the chassis members 12 pivotally about the main transit wheels 13 thus bringing the rear wheels 33 into engagement with the ground. A box 34 is mounted on the rear face of the rear panel 32 and accommodates components of an electronic control system for controlling operation of the electric motor 18 and the suction pump 25.

The carriage 11 has a handle 35 which is mounted at the upper part of the rear face of the rear panel 32. The handle 35 has an upwardly and rearwardly extending elongate shaft with a handle bar fastened to its upper end. An operator of the machine can use the handle 35 to rock the carriage 11 backwards on the transit wheels 13 with respect to the floor surface 20, thereby to raise the front end of the carriage 11 and to lift the workhead assembly 15 and bring the rear wheels 33 into engagement with the ground, thereby setting the machine 10 for storage.

A U-shaped handle 28 is hinged at either of the ends of its arms to a respective side of the trolley 22 as shown at 29 in FIGS. 3 to 5. The two arms extend rearwardly from the hinges 29 so that the cross piece of the U-shaped handle 28 is at the rear end of the machine 10. A laterally outwardly extending pin 31 is mounted on each arm of the U-shaped handle 28.

A locator plate 36 is mounted at the rear end of each chassis member 12 above the respective transit wheel 13. The locator plate 36, is formed with three juxtaposed upwardly opening slots 37, 38, 39 which are each sized to receive and retain the respective laterally extending pin 31. Hence each pin 31, cooperates with the respective slot 37-39 in which it is engaged to form a detent which prevents movement of the batteries 24 in either the fore or aft directions relative to the carriage 11. The portion of the locator plate 36 that forms the forward surface of the forward slot 37 projects upwards beyond the mouth of that slot 37 to form an upstanding forward portion 41. The portion of the locator plate 36 that forms the rearward surface of the rear slot 39 forms an upstanding rearward portion 42.

In order to prepare the machine 10 for a floor scrubbing or finishing operation, an operator selects a loading on the brush 19 appropriate for the floor scrubbing or finishing operation to be undertaken. The distance between the front and rear of the three slots 37 to 39 is short, being of the order of only 40 mm. FIG. 3 shows the pin 31 engaged in the middle slot 38 of the three slots 37 to 39 and in a preferred embodiment that is the standard brush pressure which would be of the order of 24.5 kilograms. Should the operator decide that that brush pressure should be increased, he would increase it to about 28 kilograms by raising the U-shaped handle 28 until the pin 31 has been raised out of the middle slot 38 when he would then push the handle 28 forward, thus pushing the batteries 24 forward the short distance until the pin 31 is brought into abutment with the upstanding forward portion 41 of the locator plate 36 which would stop further forwards movement of the batteries 24. The operator would then lower the pin 31 into the forward slot 37 as shown in FIG. 4. On the other hand should the operator decide that a pressure between the brush and the floor surface 20 which is lower than the standard brush pressure of 24.5 kilograms was required, the operator would raise the U-shaped handle 28 until the pin 31 had been lifted out of the middle slot 38 and would pull the trolley 22 backwards until the pin 31 was brought into abutment with the upstanding rearward portion 42 of the locator plate 36 when the handle 28 would be released and the pin 31 dropped into the rear slot 39. Thus, the loading on the brush 19 can be altered by about 33% between the lightest and heaviest duty by moving the batteries 24 over the short distance of about 40 ml.

The invention claimed is:

1. A machine for scrubbing or finishing a floor surface comprising carriage means adapted for translational movement over a floor surface, a workhead, an electric motor carried by the carriage means and arranged in use to drive the workhead and battery support means comprising a trolley which runs on rails mounted in said carriage means and adapted in use to support at least one battery as a source of electric power for driving the electric motor, wherein said battery support means are adapted to support said at least one battery so that said at least one battery can be positioned in a selected one of a range of positions relative to said workhead whereby the loading on said workhead can be varied as required by a detent arrangement which comprises a laterally projected pin on a handle and a cooperating locator plate which is formed with a plurality of upwardly opening slots each adapted to receive the pin, the slots being spaced from one another by a short distance in the direction of movement of the trolley along the rails.

2. A machine for scrubbing or finishing a floor surface comprising carriage means adapted for translational movement over a floor surface, a workhead and an electric motor carried by the carriage means and arranged to drive the workhead, battery support means adapted to support at least one battery as a source of electric power for driving the electric motor, wherein the workhead is located at a front end region of the carriage means and transit wheels are disposed towards a rear region of the carriage means so that the weight of the machine is shared between the rear transit wheels and the workhead whilst the machine is in use, characterised in that said battery support means are configured so that said at least one battery can be positioned in a selected one of a range of positions extending between the rear transit wheels and the workhead so as to vary the loading on said workhead.

3. A machine for scrubbing or finishing a floor surface according to claim 2, wherein said battery support means comprises a rolling platform.

4. A machine for scrubbing or finishing a floor surface according to claim 2, wherein said battery support means comprises a trolley which runs on rails mounted in said carriage means.

5. A machine for scrubbing or finishing a floor surface according to claim 4, wherein said trolley is provided with a handle by which it can be pulled or pushed a short distance along the rails within the machine.

6. A machine for scrubbing or finishing a floor surface according to claim 2, wherein a detent arrangement is provided for each of a plurality of selectable ones of said range of positions.

7. A machine for scrubbing or finishing a floor surface according to claim 2, wherein said battery support means comprises a trolley which runs on rails mounted in said carriage means, wherein a detent arrangement is provided for each of a plurality of selectable ones of said range of positions and wherein said detent arrangement comprises a laterally projecting pin on a handle and cooperating locator plate which is formed with a plurality of upwardly opening slots each adapted to receive the pin, the slots being spaced from one another by a short distance in the direction of movement of the trolley along the rails.

* * * * *